US010724512B2

(12) United States Patent
Sorgona et al.

(10) Patent No.: US 10,724,512 B2
(45) Date of Patent: Jul. 28, 2020

(54) RECIPROCATING COMPRESSOR

(71) Applicant: Nuovo Pignone Tecnologie Srl, Florence (IT)

(72) Inventors: Federico Sorgona, Florence (IT); Gianni Orsi, Florence (IT); Alberto Babbini, Florence (IT); Massimo Bargiacchi, Florence (IT); Ricardo Maleci, Florence (IT)

(73) Assignee: NUOVO PIGNONE TECNOLOGIE SRL, Florence (IT)

( * ) Notice: Subject to any disclaimer, the term of this patent is extended or adjusted under 35 U.S.C. 154(b) by 78 days.

(21) Appl. No.: 15/766,978

(22) PCT Filed: Oct. 4, 2016

(86) PCT No.: PCT/EP2016/073694
§ 371 (c)(1),
(2) Date: Apr. 9, 2018

(87) PCT Pub. No.: WO2017/060253
PCT Pub. Date: Apr. 13, 2017

(65) Prior Publication Data

US 2018/0291884 A1 Oct. 11, 2018

(30) Foreign Application Priority Data

Oct. 9, 2015 (IT) ..... 102015000060102

(51) Int. Cl.
*F04B 39/12* (2006.01)
*F04B 39/10* (2006.01)

(52) U.S. Cl.
CPC ..... *F04B 39/125* (2013.01); *F04B 39/10* (2013.01); *F04B 39/122* (2013.01); *F04B 39/126* (2013.01); *F04B 39/1013* (2013.01)

(58) Field of Classification Search
CPC .... F04B 39/10; F04B 39/1013; F04B 39/122; F04B 39/125; F04B 39/126
(Continued)

(56) References Cited

U.S. PATENT DOCUMENTS 677,474 A * 7/1901 Russell ..... F04B 43/0054 92/100
1,594,986 A * 8/1926 Longacre ..... F04B 39/1013 417/440
(Continued)

FOREIGN PATENT DOCUMENTS

CH 106634 A 9/1924
GB 1367164 A * 9/1974 ..... F04B 39/10

OTHER PUBLICATIONS

Italian Search Report and Written Opinion issued in connection with corresponding IT Application No. 102015000060102 dated May 31, 2016 (English Translation not available).
(Continued)

*Primary Examiner* — Nathan C Zollinger
(74) *Attorney, Agent, or Firm* — Baker Hughes Patent Organization

(57) ABSTRACT

It is disclosed a reciprocating compressor having a cylinder body that defines a cylinder; the cylinder may have a cylinder lateral wall and a cylinder axis A and inside it a piston is movable; at least one valve is provided to selectively open and close a valve opening formed in the cylinder lateral wall; cylinder heads at least partially protruding towards the piston inside the cylinder have a recessed surface at least partially facing the valve openings; an intersection between at least a plane containing the cylinder axis A and the recessed surface is a first curve having at least a convex part facing the valve opening.

19 Claims, 3 Drawing Sheets

(58) Field of Classification Search
USPC ..... 417/536, 537, 535
See application file for complete search history.

(56) References Cited

U.S. PATENT DOCUMENTS

| | | | | |
|---|---|---|---|---|
| 1,719,998 | A * | 7/1929 | Prellwitz | F04B 39/064 417/536 |
| 3,165,116 | A * | 1/1965 | Rosenschold | F04B 39/1073 137/512.1 |
| 3,602,247 | A * | 8/1971 | Bunn | F04B 39/1013 137/270 |
| 5,622,486 | A * | 4/1997 | McDuffie | F04B 39/10 417/536 |
| 6,607,366 | B2 * | 8/2003 | Sperry | F04B 39/1013 137/522 |
| 8,118,574 | B1 * | 2/2012 | Sperry | F04B 39/10 137/512.1 |
| 2002/0141884 | A1 | 10/2002 | Sperry | |
| 2009/0238699 | A1 | 9/2009 | Sanford | |

OTHER PUBLICATIONS

International Search Report and Written Opinion issued in connection with corresponding PCT Application No. PCT/EP2016/073694 dated Dec. 14, 2016.
International Preliminary Report on Patentability issued in connection with corresponding PCT Application No. PCT/EP2016/073694 dated Apr. 10, 2018.

* cited by examiner

RECIPROCATING COMPRESSOR

Embodiments of the subject matter disclosed herein correspond to a reciprocating compressor.

In particular, the disclosure relates to a reciprocating compressor comprising valves having at least a valve axis that is perpendicular to a cylinder axis.

BACKGROUND

In the field of "Oil & Gas", reciprocating compressors are widely used.

US2002/0141884-A1 describes an unloader system is provided for a reciprocating gas compressor. The system includes an unloader valve assembly including a valve member controlling flow between compressor cylinder and a clearance bottle. Opening and closing of the valve member is controlled by manipulating a control pressure acting through a manifold against the stem of the valve member by means of a pressure regulator connected in series with a pressure source. When the pressure in the compressor cylinder acting on the heads of the poppet valve members exceeds the control pressure acting on the stems, the poppet valve members open, partially unloading the compressor.

Each cylinder head of the reciprocating compressor described in the cited document has an annular chamfer with a concave surface partially facing the valve openings.

In different known designs, the cylinder head may a have plurality of slots, each facing a valve opening. Each slot have a concave surface, shaped as a part of a sphere (therefore with a constant radius).

The fluid, when aspired into the compression chamber and when leaving it, runs onto the concave surface of the chamfer or of the slots. This generates pressure losses that lower the efficiency of the compressor.

SUMMARY

Therefore, there is a general need for an improved reciprocating compressor, which may have reduced pressure losses and improved adiabatic efficiency with respect the known reciprocating compressors.

An important idea is to create a recessed surface at least partially facing the valve opening that have a convex part facing the valve opening.

This new shape may lead to decreased aerodynamic resistance with a clearance volume comparable to the one of the known compressors.

A first embodiment of the subject matter disclosed herein corresponds to a reciprocating compressor.

BRIEF DESCRIPTION OF DRAWINGS

The accompanying drawings, which are incorporated herein and constitute a part of the specification, illustrate exemplary embodiments of the present invention and, together with the detailed description, explain these embodiments. In the drawings.

DETAILED DESCRIPTION

The following description of exemplary embodiments refers to the accompanying drawings.

The following description does not limit the invention. Instead, the scope of the invention is defined by the appended claims.

The description relates to a reciprocating compressor having a plurality of valves. A recessed surface is positioned in front of at least one valve, having at least a convex part facing the valve. The shape of the recessed surface optimizes the trade-off between the cylinder dead volume and the pressure losses.

Figure 1:
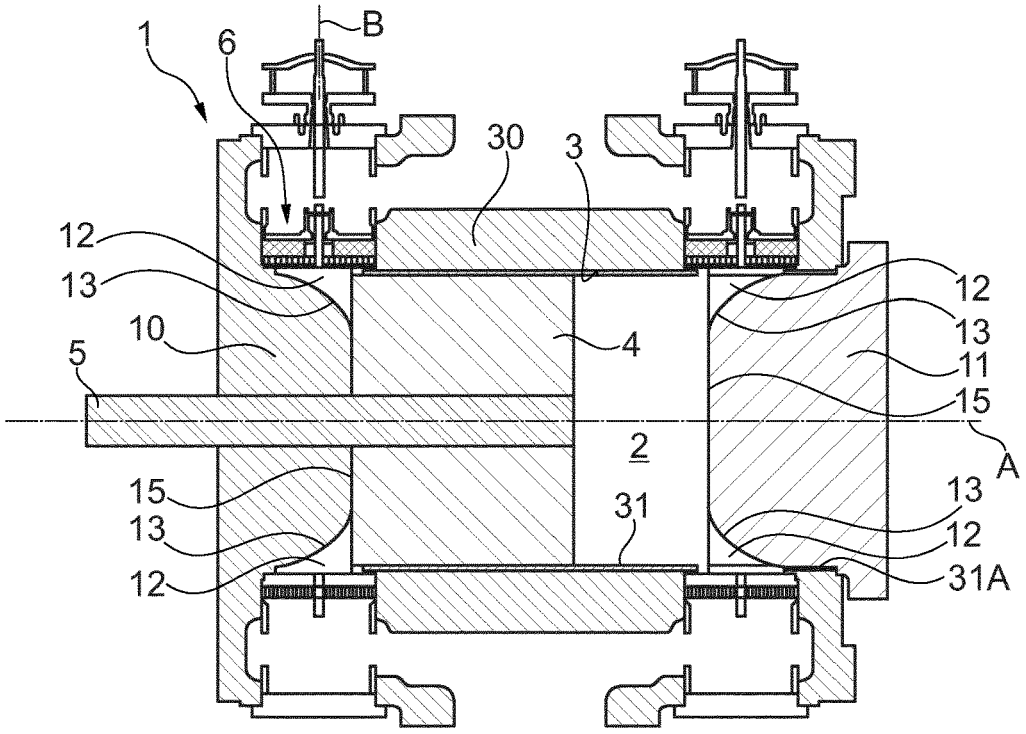
FIG. 1 is a simplified cross section of a reciprocating compressor of the present description.

FIG. 1 is a cross-sectional view showing an embodiment of an improved reciprocating compressor overall indicated with reference number 1. The reciprocating compressor 1, comprises a cylinder body 30 defining a cylinder 2 having a cylinder lateral wall 3. The cylinder lateral wall 3 has a cylinder axis A and may comprise a cylinder liner 31 coupled to the cylinder body 30. In one embodiment a liner spacer 31A may extend from a cylinder head 10, 11 to the cylinder liner 31.

A piston 4 is movable inside the cylinder 2, and is coupled to a piston rod 5 extending through a cylinder head 10. The piston rod 5 may be conventionally connected to a system designed to transmit a reciprocating movement to the piston 4.

Figure 7:
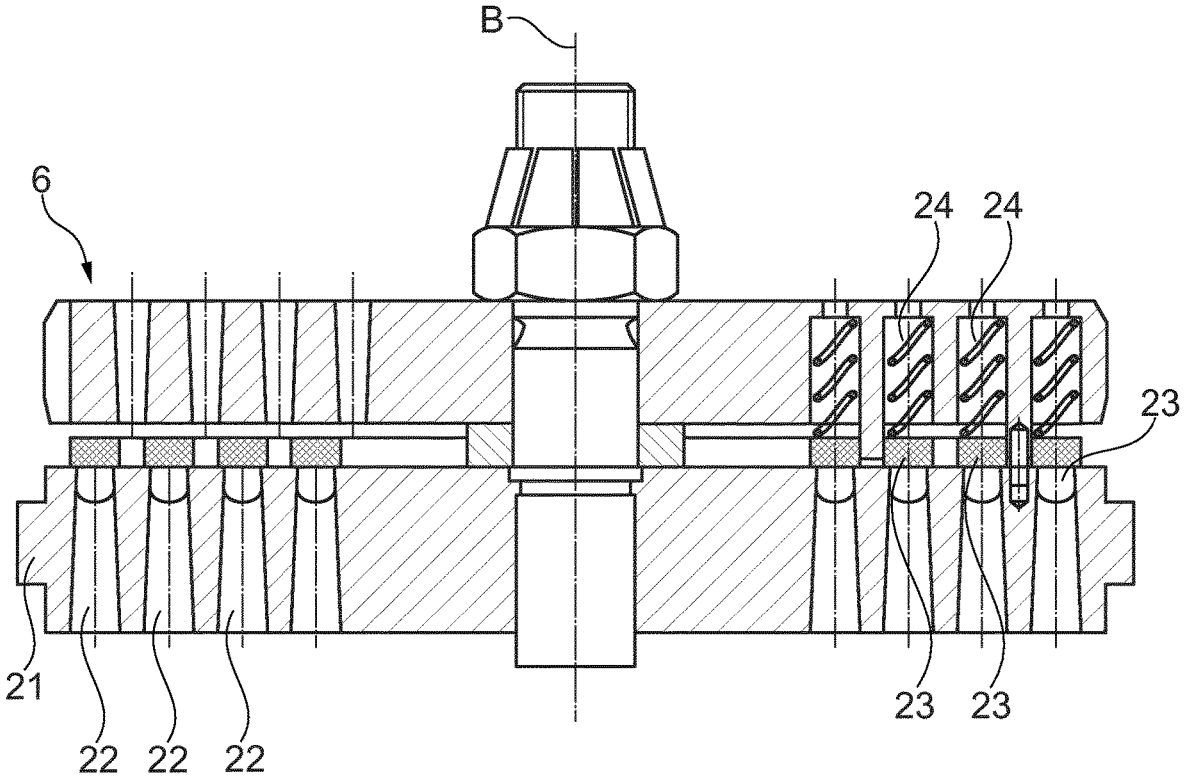
FIG. 7 is a cross section of a valve of the compressor of FIG. 1.

At least one valve 6, may be provided to selectively open and close a valve opening 7 formed in the cylinder lateral wall 3. The valve opening 7 may be at least partially formed in the cylinder liner 31 and/or in the liner spacer 31A. The valve 6 that may be of the type represented in FIG. 7 may be housed in the valve opening 7, and may comprise a valve seat 21. The valve 6 may comprise a plurality of valve passages 22 formed in a valve seat 21. As it may be appreciated from the figures, the valve passages 22 face the valve opening 7. Moreover the valve seat 21, may accommodate conventional valve members 23 urged by springs 24 in a closing direction of the valve passages 22. When the pressure acting on the valve members 23 overcomes the force of the springs 24, the valve members 23 may compress the springs 24 so as to allow a flow of the fluid. The configuration of the valve 6 and its operation is conventional and it will not be further described as it is evident for the skilled person.

As it may be seen in FIG. 1, at least a cylinder head 10, 11 may at least partially protrude towards the piston 4 inside the cylinder 2. The cylinder head 10, 11 has at least a recessed surface 12, at least partially facing the valve opening 7.

Figure 2:
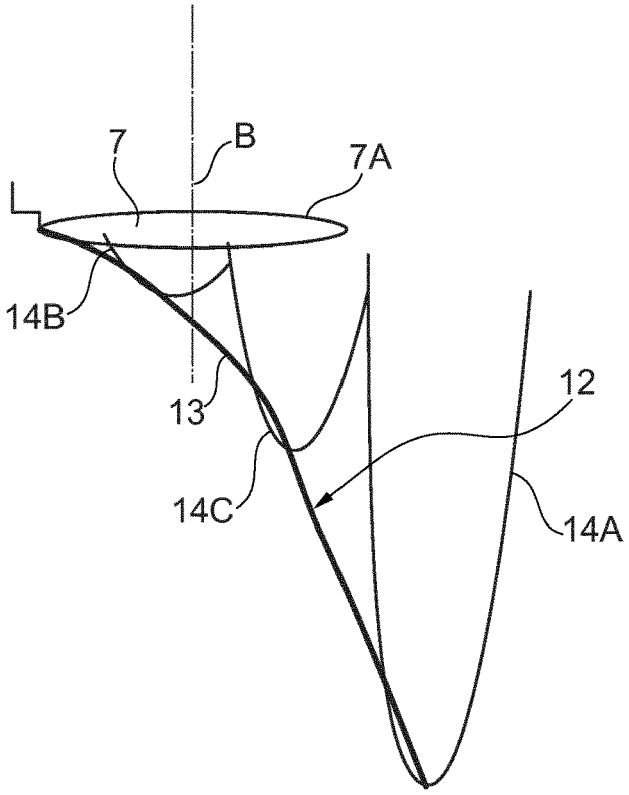
FIG. 2 is a simplified schematic view of a recessed surface of the compressor of FIG. 1.

The shape of the recessed surface 12 is schematically shown in FIG. 2. Moreover FIGS. 3, 4, 5 and 6 show different cross-sections taken on the recessed surface 12.

According to one aspect of the present embodiment, an intersection between at least a plane containing the cylinder axis A and the recessed surface 12 is a first curve 13 (see FIG. 3) having a convex part facing the valve opening 7. The curve 13 is therefore convex when viewed form the valve opening 7.

Moreover the intersection between at least a plane P1, P2, P3 perpendicular to the cylinder axis A and the recessed surface 12 is a further curve 14A, 14B, 14C (see FIGS. 4, 5 and 6) having a concavity facing the valve opening 7. The further curve may be a polynomial curve, second order polynomial curve.

The intersection between the recessed surface 12 and at least a first plane P1 perpendicular to the cylinder axis A and further containing (or located in proximity of) a free end 15 of the cylinder head 10, 11 may be a second curve 14A (shown in FIG. 6) at least partially defined by the equation:

$$i \cdot y = A_3x^2 + B_3x + C_3,$$

wherein $A_3$, $B_3$ and $C_3$ are constants. Their value can be either positive of negative depending on the position of the coordinate system. $A_3$ shall be different from zero.

Figure 3:
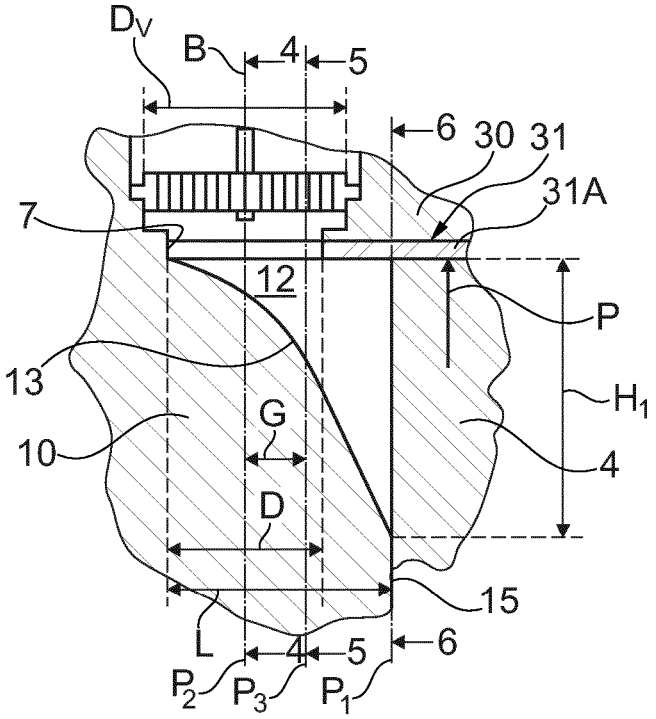
FIG. 3 is an enlarged view of a part of the compressor of FIG. 1.

As shown in FIG. 3 the distance L of the free end 15 form a border of the valve opening 7 may be lower or greater than the diameter D of the valve opening 7. In an embodiment the distance L may be greater than 0 and up to Dv (valve diameter).

Figure 4:
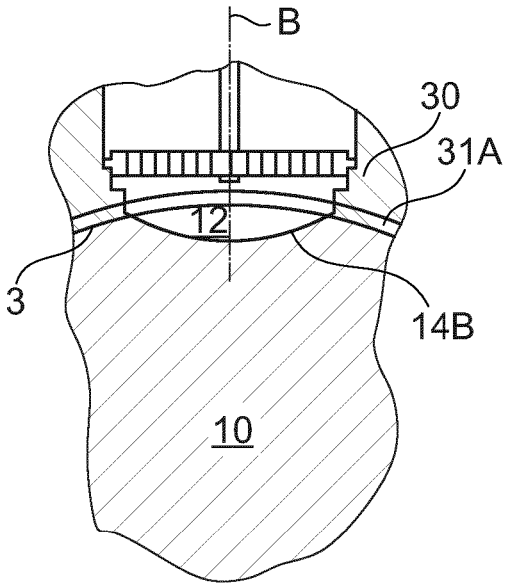
FIG. 4 is a cross section taken on line 4-4 of FIG. 3.

FIG. 4 shows that the intersection between the recessed surface 12 and at least a second plane P2 perpendicular to the cylinder axis A and further containing a valve axis B may be a third curve 14B at least partially defined by the equation:

$$i \cdot y = A_1x^2 + B_1x + C_1$$

wherein $A_1$, $B_1$ and $C_1$ are constants. Their value can be either positive of negative depending on the position of the coordinate system. $A_1$ shall be different from zero.

Figure 5:
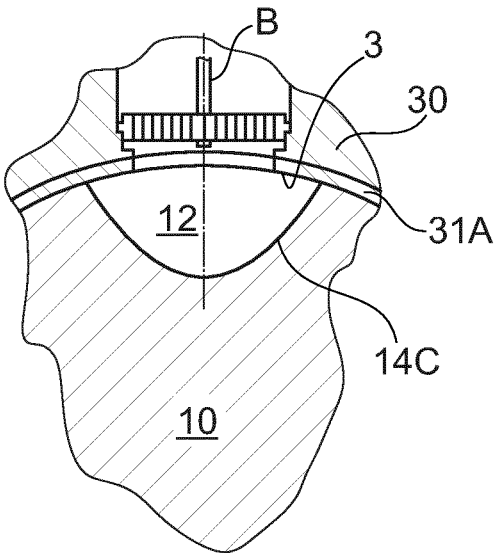
FIG. 5 is a cross section taken on line 5-5 of FIG. 3.
Figure 6:
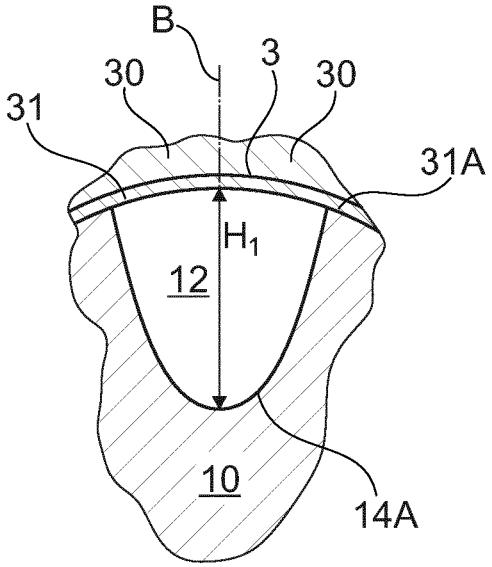
FIG. 6 is a cross section taken on line 6-6 of FIG. 3.

FIG. 5 shows that the intersection between the recessed surface 12 and at least a third plane P3 perpendicular to the cylinder axis A and further lying between the valve axis B and the free end 15 of the cylinder head 10, 11 may be a fourth curve 14C least partially defined by the equation:

$$i \cdot y = A_2x^2 + B_2x + C_2$$

wherein $A_2$, $B_2$ and $C_2$ are constants. Their value can be either positive of negative depending on the position of the coordinate system. $A_2$ shall be different from zero.

The distance G from the valve axis B to the plane P3 may be >0, and up to L-D/2.

Basically the shape of the recessed surface 12 is defined by the interpolation of at least a base curve 7A of the valve opening 7 and the second curve 14A.

Moreover the shape of the recessed surface 12 may be further defined by the interpolation of the third curve 14B and/or of the fourth curve 14C.

The base curve 7A may be defined by an opening formed in the cylinder lateral wall 3 or in the cylinder liner 31.

In one embodiment the base curve 7A may be the intersection of a first cylinder of axis B and diameter Dv, and a second cylinder of axis A and diameter equal to the one of the cylinder 2.

In a different embodiment, the base curve 7A may be the intersection of the first cylinder (having axis B and diameter Dv), with and a plane perpendicular to the plane containing axes A and B.

In again a different embodiment, the base curve 7A may be the intersection of the first cylinder (having axis B and diameter Dv), with a third cylinder with same diameter of cylinder 2, but with an axis lying on the same plane of axes A and B and inclined with respect to both axis A and B.

In an embodiment, the described reciprocating compressor may be configured to work at a pressure comprised between atmospheric pressure (or slightly lower) and 600 Bar.

For those kind of compressors, the valve axis B may be perpendicular to the cylinder axis A.

According to one aspect, the vertices of the second curve 14A, of the third curve 14B, and of the fourth curve 14C, may belong to the first curve 13, having a convexity facing, or at least partially facing the valve opening 7.

The reciprocating compressor 1, as above described, may comprise a plurality of valve openings 7 facing (or at least partially facing) a plurality of recessed surfaces 12 located on each cylinder head 10, 11.

In an embodiment the shape of all the recessed surfaces facing the valve openings 7 of the reciprocating compressor is identical or almost identical.

In an embodiment, a number from two to ten valve openings 7 may be located at one side of the piston 4, and the same number of valve openings 7 may be located on the other side. For each side, half of the valve openings 7 may be dedicated to the inlet of the fluid to be compressed in the compression chamber, and the other half number of valve openings 7 may be dedicated to the outlet of the fluid from the compression chamber. The shape of the recessed surface 12 provided in front of the inlet valve openings 7 and on the outlet valve openings 7 may be identical or very similar.

Moreover one 10 of the cylinder heads may be formed in one piece with the cylinder body 30. Another cylinder head 11 may be removably fixed (for example by bolts or any other suitable means) to the cylinder body 30.

The reciprocating compressor as above described may have a valve diameter Dv (see FIG. 3) from 85 mm to 345 mm. The diameter D of the valve opening 7 may be comprised form Dv*0.3 to Dv.

The piston diameter P may vary from 80 mm to 1300 mm, and the maximum height $H_1$ of the recessed surface 12 may be comprised between 10 mm and P/2. (where P is the piston diameter). As it may be clear from the drawings, the maximum height $H_1$ is taken on the plane P1.

The aerodynamic profile of the recessed surface 12 as above described, is now an extension of the valve space, that may help in avoiding abrupt discontinuities in the flow path from gas chamber to cylinder 2 in case of suction valves and vice-versa in case of discharge ones (which in the prior art led to an increase in pressure losses). The present recessed surface 12 leaves no reflux zones or useless dead volume, giving an increased cylinder adiabatic efficiency.

The proposed design offers less aerodynamic resistance than the known designs, maintaining the same cylinder clearance volume.

The required clearance volume is minimized due to the variable cross-section of the recessed surface, which leaves no reflux zones from the cylinder valve to the cylinder bore.

The proposed shape of the recessed surface 12, is derived form a surface connecting the cylinder valve hole (or the cylinder liner/spacer) with two (or more) consecutives custom profiles (i.e. polynomial, etc.) with different cross-section.

As described, the recessed surface shape, could be realized within a cylinder head 10 formed in the same piece of the cylinder body 30 or in a removable cylinder head 11 by casting, machining or other tools.

The recessed surface shape can also be obtained by the assembly of different parts, e.g. cylinder head, cylinder liner, liner spacer and the cylinder itself, or different combinations thereof.

The component with the recessed surface 12 may be made of metallic, plastic and/or composite materials.

The improvements given from the described design may lead to:

a reduced power needed at the crankshaft;

a more efficient use of the cylinder dead volume;

an improved Cylinder Adiabatic Efficiency (without reduction of Volumetric Efficiency);

to a more uniform flow through valves; and it may help in avoiding Piston Masking effects (piston masking occurs when the piston approaches the dead center, gradually closing the openings 7, thereby decreasing the passage area for the gas).

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

One or more embodiments of the disclosure may comprise one or more of the following clauses, alone or in combination.

In particular, an embodiment refers to a reciprocating compressor 1, comprising:

a cylinder body 30 defining a cylinder 2, the cylinder 2 having a cylinder lateral wall 3 and a cylinder axis A, a piston 4 movable inside the cylinder 2, at least one valve 6 configured to selectively open and close a valve opening 7 formed in the cylinder lateral wall 3, at least a cylinder head 10, 11 that at least partially protrudes towards the piston 4 inside the cylinder 2, the cylinder head 10, 11 having a recessed surface 12 at least partially facing the valve opening 7; an intersection between at least a plane containing the cylinder axis A and the recessed surface 12 is a first curve 13 having at least a convex part facing the valve opening 7.

According to one aspect the intersection between at least a plane P1, P2, P3 perpendicular to the cylinder axis A and the recessed surface 12 is a further curve 14A, 14B, 14C having a concavity facing the valve opening 7.

According to again another aspect intersection between the recessed surface (12) and at least a first plane (P1) perpendicular to the cylinder axis (A) and further containing a free end (15) of the cylinder head (10, 11) is a second curve (14A) at least partially defined by the equation: $y=A_3x^2+B_3x+C_3$, wherein $A_3$, $B_3$ and $C_3$ are constants, and the value of $A_3$ is $\neq 0$.

According to a further aspect the intersection between the recessed surface 12 and at least a second plane P2 perpendicular to the cylinder axis A and further containing a valve axis B is a third curve 14B at least partially defined by the equation: $y=A_1x^2+B_1x+C_1$, wherein $A_1$, $B_1$ and $C_1$ are constants, and the value of $A_1$ is $\neq 0$.

According to again another aspect the intersection between the recessed surface 12 and at least a third plane P3 perpendicular to the cylinder axis A and further lying between the valve axis B and the free end 15 of the cylinder head 10, 11 is a fourth curve 14C least partially defined by the equation: $y=A_2x^2+B_2x+C_2$, wherein $A_2$, $B_2$ and $C_2$ are constants, and the value of $A_2$ is $\neq 0$.

According to a further aspect the shape of the recessed surface 12 is defined by the interpolation of at least a base curve 7A of the valve opening 7 and the second curve 14A.

According to again another aspect the shape of the recessed surface 12 is further defined by the interpolation of the third curve 14B and/or of the fourth curve 14C.

According to a further aspect the base curve 7A is defined by an opening formed in the cylinder lateral wall 3.

According to again another aspect a valve axis B is perpendicular to the cylinder axis A.

According to a further aspect the vertexes of the second curve 14A, of the third curve 14B, and of the fourth curve 14C belong to the first curve 13.

According to again another aspect the valve opening 7 houses a valve 6 comprising a plurality of valve passages 22 formed in a valve seat 21, the valve passages 22 facing the valve opening 7.

According to a further aspect a cylinder head 10 is formed in one piece with a cylinder body 30.

According to again another aspect a cylinder head 11 is removably fixed to the cylinder body 30.

According to a further aspect the cylinder lateral wall 3 is defined by a cylinder liner 31 coupled to the cylinder body 30.

According to again another aspect a liner spacer 31A extents from the cylinder head 10 to the cylinder liner 31, the valve opening 7 being at least partially formed in the cylinder liner 31 and/or in the liner spacer 31A.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. In addition, the order or sequence of any process or method steps may be varied or re-sequenced according to alternative embodiments.

The invention claimed is:

1. A reciprocating compressor, comprising:

a cylinder body defining a cylinder, the cylinder having a cylinder lateral wall and a cylinder axis;

a piston movable inside the cylinder;

at least one valve configured to selectively open and close a valve opening formed in the cylinder lateral wall; and at least a cylinder head that at least partially protrudes towards the piston inside the cylinder, the cylinder head having a recessed surface at least partially facing the valve opening, wherein at least (i) an intersection, between a first plane containing the cylinder axis and the recessed surface, is a first curve having at least a convex part facing the valve opening, (ii) an intersection, between a second plane perpendicular to the cylinder axis and the recessed surface, is a second curve having a concavity facing the valve opening, and (iii) an intersection, between a third plane perpendicular to the cylinder axis, is a third curve having a concavity facing the valve opening.

2. The reciprocating compressor of claim 1, wherein the intersection between a fourth plane perpendicular to the cylinder axis and the recessed surface is a fourth curve having a concavity facing the valve opening.

3. The reciprocating compressor of claim 1, wherein the shape of the recessed surface is defined by the interpolation of at least a base curve of the valve opening and the second curve.

4. The reciprocating compressor of claim 2, wherein the shape of the recessed surface is defined by the interpolation of at least a base curve of the valve opening and the second curve, and is further defined by the interpolation of the third curve and/or of the fourth curve.

5. The reciprocating compressor of claim 3, wherein the base curve is defined by an opening formed in the cylinder lateral wall.

6. The reciprocating compressor of claim 1, wherein a valve axis is perpendicular to the cylinder axis.

7. The reciprocating compressor of claim 2, wherein the vertexes of the second curve, the third curve, and the fourth curve belong to the first curve.

8. The reciprocating compressor of claim 1, wherein the valve opening houses a valve comprising a plurality of valve passages formed in a valve seat, the valve passages facing the valve opening.

9. The reciprocating compressor of claim 1, wherein the cylinder head is formed in one piece with the cylinder body.

10. The reciprocating compressor of claim 1, wherein the cylinder head is removably fixed to the cylinder body.

11. The reciprocating compressor of claim 9, wherein the cylinder lateral wall is defined by a cylinder liner coupled to the cylinder body.

12. The reciprocating compressor of claim 11, wherein a liner spacer extents from the cylinder head to the cylinder liner, the valve opening being at least partially formed in the cylinder liner and/or in the liner spacer.

13. The reciprocating compressor of claim 1, wherein the second curve is at least partially defined by the equation:

$$y=A_3x^2+B_3x+C_3$$

wherein $A_3$, $B_3$ and $C_3$ are constants, and the value of $A_3$ is 0.

14. The reciprocating compressor of claim 1, wherein the third curve is at least partially defined by the equation:

$$y=A_1x^2+B_1x+C_1$$

wherein $A_1$, $B_1$ and $C_1$ are constants, and the value of $A_1$ is 0.

15. The reciprocating compressor of claim 2, wherein the fourth curve is at least partially defined by the equation:

$$y=A_2x^2+B_2x+C_2$$

wherein $A_2$, $B_2$ and $C_2$ are constants, and the value of $A_2$ is 0.

16. The reciprocating compressor of claim 15, wherein the second curve is at least partially defined by the equation:

$$y=A_3x^2+B_3x+C_3$$

wherein $A_3$, $B_3$ and $C_3$ are constants, and the value of $A_3$ is 0; and the third curve is at least partially defined by the equation:

$$y=A_1x^2+B_1x+C_1$$

wherein $A_1$, $B_1$ and $C_1$ are constants, and the value of $A_1$ is 0.

17. A reciprocating compressor, comprising:

a cylinder body defining a cylinder, the cylinder having a cylinder lateral wall and a cylinder axis;

a piston movable inside the cylinder;

at least one valve configured to selectively open and close a valve opening formed in the cylinder lateral wall; and at least a cylinder head that at least partially protrudes towards the piston inside the cylinder, the cylinder head having a recessed surface at least partially facing the valve opening, wherein at least (i) an intersection, between the recessed surface and a plane containing the cylinder axis, is a first curve having at least a convex part facing the valve opening, and (ii) an intersection, between the recessed surface and a plane perpendicular to the cylinder axis and proximate to a free end of the cylinder head, is a curve at least partially defined by the equation:

$$y=A_3x^2+B_3x+C_3$$

wherein $A_3$, $B_3$ and $C_3$ are constants, and the value of $A_3$ is $\neq 0$.

18. A reciprocating compressor, comprising:

a cylinder body defining a cylinder, the cylinder having a cylinder lateral wall and a cylinder axis;

a piston movable inside the cylinder;

at least one valve configured to selectively open and close a valve opening formed in the cylinder lateral wall; and at least a cylinder head that at least partially protrudes towards the piston inside the cylinder, the cylinder head having a recessed surface at least partially facing the valve opening, wherein at least (i) an intersection, between the recessed surface and a plane containing the cylinder axis, is a curve having at least a convex part facing the valve opening, and (ii) an intersection, between the recessed surface and a plane perpendicular to the cylinder axis and containing a valve axis, is a curve at least partially defined by the equation:

$$y=A_1x^2+B_1x+C_1$$

wherein $A_1$, $B_1$ and $C_1$ are constants, and the value of $A_1$ is 0.

19. A reciprocating compressor, comprising:

a cylinder body defining a cylinder, the cylinder having a cylinder lateral wall and a cylinder axis;

a piston movable inside the cylinder;

at least one valve configured to selectively open and close a valve opening formed in the cylinder lateral wall; and at least a cylinder head that at least partially protrudes towards the piston inside the cylinder, the cylinder head having a recessed surface at least partially facing the valve opening, wherein at least (i) an intersection, between the recessed surface and a plane containing the cylinder axis, is a curve having at least a convex part facing the valve opening, and (ii) an intersection, between the recessed surface and a plane perpendicular to the cylinder axis between a valve axis and a free end of the cylinder head, is a curve at least partially defined by the equation:

$$y=A_2x^2+B_2x+C_2$$

wherein $A_2$, $B_2$ and $C_2$ are constants, and the value of $A_2$ is 0.

* * * * *